US005418107A

United States Patent [19]

Nealey et al.

[11] Patent Number: 5,418,107

[45] Date of Patent: May 23, 1995

[54] PROCESS FOR FABRICATING AN ELECTROPHOTOGRAPHIC IMAGING MEMBERS

[75] Inventors: Richard H. Nealey, Penfield; Martha J. Stegbauer, Ontario; Steven J. Grammatica, Penfield; James M. Markovics, Rochester, all of N.Y.

[73] Assignee: Xerox Corporation, Stamford, Conn.

[21] Appl. No.: 106,477

[22] Filed: Aug. 13, 1993

[51] Int. Cl.[6] ..... G03G 5/06; G03G 5/14

[52] U.S. Cl. ..... 430/132; 430/134

[58] Field of Search ..... 430/132, 134

[56] References Cited

U.S. PATENT DOCUMENTS

| | | | |
|---|---|---|---|
| 3,121,006 | 6/1957 | Middleton et al. | 430/96 |
| 4,264,990 | 5/1981 | Stolka et al. | 430/59 |
| 4,429,029 | 1/1984 | Hoffmann et al. | 430/57 |
| 4,514,482 | 4/1985 | Loutfy et al. | 430/78 |
| 4,587,189 | 5/1986 | Hor et al. | 430/59 |
| 4,728,592 | 3/1988 | Ohaku et al. | 430/59 |
| 4,882,254 | 11/1989 | Loutfy et al. | 430/59 |
| 4,898,799 | 2/1990 | Fujimaki et al. | 430/59 |
| 5,019,473 | 5/1991 | Nguyen et al. | 430/58 |
| 5,055,368 | 10/1991 | Nguyen et al. | 430/78 |
| 5,114,815 | 5/1992 | Oda et al. | 430/58 |
| 5,153,313 | 10/1992 | Kazmaier et al. | 540/138 |
| 5,189,155 | 2/1993 | Mayo et al. | 540/141 |
| 5,189,156 | 2/1993 | Mayo et al. | 540/141 |
| 5,206,359 | 4/1993 | Mayo et al. | 540/141 |
| 5,324,615 | 6/1994 | Stegbauer et al. | 430/132 |

*Primary Examiner*—Roland Martin

[57] ABSTRACT

A process for fabricating an electrophotographic imaging member including providing a substrate to be coated, forming a coating comprising photoconductive pigment particles having an average particle size of less than about 0.6 micrometer dispersed in a solution of a solvent comprising n-alkyl acetate having from 3 to 5 carbon atoms in the alkyl group and a film forming polymer consisting essentially of a film forming polymer having a polyvinyl butyral content between about 50 and about 75 mol percent, a polyvinyl alcohol content between about 12 and about 50 mol percent, and a polyvinyl acetate content is between about 0 to 15 mol percent, the photoconductive pigment particles including a mixture of at least two different phthalocyanine pigment particles free of vanadyl phthalocyanine pigment particles, drying the coating to remove substantially all of the alkyl acetate solvent to form a dried charge generation layer comprising between about 50 percent and about 90 percent by weight of the pigment particles based on the total weight of the dried charge generation layer, and forming a charge transport layer.

12 Claims, No Drawings

PROCESS FOR FABRICATING AN ELECTROPHOTOGRAPHIC IMAGING MEMBERS

BACKGROUND OF THE INVENTION

This invention relates in general to electrophotographic imaging members and more specifically, to a process for fabricating an electrophotographic imaging member having an improved charge generation layer.

In the art of electrophotography an electrophotographic plate comprising a photoconductive insulating layer on a conductive layer is imaged by first uniformly electrostatically charging the imaging surface of the photoconductive insulating layer. The plate is then exposed to a pattern of activating electromagnetic radiation such as light, which selectively dissipates the charge in the illuminated areas of the photoconductive insulating layer while leaving behind an electrostatic latent image in the non-illuminated area. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable electrophotographic imaging members.

The electrophotographic imaging members may be in the form of plates, drums or flexible belts. These electrophotographic members are usually multilayered photoreceptors that comprise a substrate, a conductive layer, an optional hole blocking layer, an optional adhesive layer, a charge generating layer, and a charge transport layer, an optional overcoating layer and, in some belt embodiments, an anti-curl backing layer.

A conventional technique for coating cylindrical or drum shaped photoreceptor substrates involves dipping the substrates in coating baths. The bath used for preparing photoconducting layers is prepared by dispersing photoconductive pigment particles in a solvent solution of a film forming binder. Unfortunately, some organic photoconductive pigment particles cannot be applied by dip coating to form high quality photoconductive coatings. For example, organic photoconductive pigment particles such benzimidazole perylene pigments tend to settle when attempts are made to disperse the pigments in a solvent solution of a film forming binder. The tendency of the particles to settle requires constant stirring which can lead to entrapment of air bubbles that are carried over into the final photoconductive coating deposited on a photoreceptor substrate. These bubbles cause defects in final prints xerographically formed with the photoreceptor. The defects are caused by differences in discharge of the electrically charged photoreceptor between the region where the bubbles are present and where the bubbles are not present. Thus, for example, the final print will show dark areas over the bubbles during discharged area development or white spots when utilizing charged area development. Moreover, many pigment particles tend to agglomerate when attempts are made to disperse the pigments in solvent solutions of film forming binders. The pigment agglomerates lead to non-uniform photoconductive coatings which in turn lead to other print defects in the final xerographic prints due to non-uniform discharge.

In addition, some dispersions react non-uniformly when deposited as a coating on a photoreceptor substrate to form discontinuous coatings during dip coating or roll coating operations. It is believed that these discontinuous coatings are caused by the coating material flowing in some regions of the coating and not in other regions.

INFORMATION DISCLOSURE STATEMENT

U.S. Pat. No. 5,153,313 to Kazmaier et al., issued Oct. 6, 1992—A process is disclosed for the preparation of phthalocyanine composites which comprises adding a metal free phthalocyanine, a metal phthalocyanine, a metalloxy phthalocyanine or mixtures thereof to a solution of trifluoroacetic acid and a monohaloalkane; adding to the resulting mixture a titanyl phthalocyanine; adding the resulting solution to a mixture that will enable precipitation of the composite, recovering the phthalocyanine composite precipitated product. Polymeric binder resins disclosed for the photogenerator layer include polyvinyl butyral. The use of a polyvinyl butyral binder in n-butyl acetate for a charge generating layer is described, for example, in Example IX.

U.S. Pat. No. 5,055,368 to Nguyen et al, issued Oct. 8, 1991—An electrophotographic recording element is disclosed having a layer formed from a liquid composition comprising polymeric binder and dispersed photoconductive titanyl phthalocyanine particles. The titanyl phthalocyanine particles have a particle size up to about 0.2 micrometer and are characterized by certain X-ray diffraction characteristics and the layers are characterized by certain spectral absorption ranges. The coating composition comprises finely-divided photoconductive titanyl phthalocyanine particles dispersed in a solvent solution of polymeric binder and is prepared by the steps of ( 1 ) milling a titanyl phthalocyanine pigment with milling media comprising inorganic salt and non-conducting particles under shear conditions in the substantial absence of the solvent to provide pigment having a particle size up to 0.2 micrometer, (2) continuing the milling at higher shear at a temperature up to about 50° C. to achieve a perceptible color change of the pigment particles, (3) rapidly increasing the temperature of the milled pigment by at least 10° C., (4) separating the milled pigment from the milling media and (5) mixing the milled pigment with the solvent solution of polymeric binder to form the coating composition. The first stage of milling may be as much as 240 hours. Poly(vinyl butyral) is listed as an example of a binder.

U.S. Pat. No. 5,019,473 to Nguyen et al, issued May 28, 1991—An electrophotographic recording element is disclosed having a layer comprising a photoconductive perylene pigment, as a charge generation material, that is sufficiently finely and uniformly dispersed in a polymeric binder to provide the element with excellent electrophotographic speed. The perylene pigments are perylene-3,4,9,10-tetracarboxylic acid imide derivatives (1) milled with with milling media comprising inorganic salt and non-conducting particles under shear conditions in the substantial absence of binder solvent to provide pigment having a particle size up to 0.2 micrometer (2) continuing the milling at higher shear and a temperature up to about 50° C. to achieve a perceptible color change of the pigment particles, (3) rapidly increasing the temperature of the milled pigment by at least 10° C., (4) separating the milled pigment from the milling media and (5) mixing the milled pigment with a solvent solution of polymeric binder to form the coating composition. The first stage of milling may be as much as 240 hours. Poly(vinyl butyral) is listed as an example of a binder.

U.S. Pat. No. 5,206,359 to Mayo et al., issued Apr. 27, 1993—A process is disclosed for the preparation of titanyl phthalocyanine which comprises a treatment of titanyl phthalocyanine Type X with a halobenzene. The disclosure includes a description of the formation of a charge generating layer using a dispersion of titanyl phthalocyanine Type IV in poly(vinyl butyral) and butyl acetate in Example II. The disclosure includes a description of the formation of a charge generating layer using a dispersion milled for 20 hours of titanyl phthalocyanine Type IV in poly(vinyl butyral) and butyl acetate in Example II.

U.S. Pat. No. 5,189,156 to Mayo et al., issued Feb. 23, 1993—A process is disclosed for the preparation of titanyl phthalocyanine which comprises a reaction of titanium tetraalkoxide and diaminoisoindolene in the presence of a halonaphthalene solvent; dissolving the resulting Type I titanyl phthalocyanine in a haloacetic acid and an alkylene halide, adding the resulting mixture slowly to a cold alcohol solution; and isolating the resulting Type X titanyl phthalocyanine with an average volume particle size diameter of from about 0.02 to about 0.5 micron. Binder resins for the generator layer include poly(vinyl butyral). Examples of solvents disclosed for the binder include, for example, butyl acetate. A photogenerator layer prepared from a coating dispersion containing titanyl phthalocyanine Type IV poly(vinyl butyral) and butyl acetate is disclosed, for example, in Example II. The particle diameter size of the Type X titanyl phthalocyanine can be from about 0.05 to about 0.5 micrometers. Mixing and/or milling of a TiOPc charge generator layer dispersion in equipment such as paint shakers, ball mills, sand mills and attritors are also disclosed. Examples of milling media include glass beads, steel balls or ceramic beads. Ball milling of titanyl phthalocyanine and poly(vinyl butyral) and butyl acetate for 20 hours is described in Example II.

U.S. Pat. No. 5,189,155 to Mayo et al., issued Feb. 23, 1993—A process is disclosed for the preparation of titanyl phthalocyanine Type I which comprises a reaction of titanium tetraalkoxide and diminoisoindolene in the presence of a halonaphthalene solvent. The photogenerator layer binder resins disclosed include poly(vinyl butyral). Also, solvents useful for coating TiOPc dispersions include butyl acetate. The formation of a photogenerator layer using a dispersion of TiOPc IV, poly(vinyl butyral) and butyl acetate milled for 20 hours is described, for example, in Example II. Mixing and/or milling of a TiOPc charge generator layer dispersion in equipment such as paint shakers, ball mills, sand mills and attritors are also disclosed. Examples of milling media include glass beads, steel balls or ceramic beads. An average Type IV particle size of about 0.05 to about 0.1 micrometers is mentioned, for example, in Example IX.

U.S. Pat. No. 5,114,815 to Oda et al, issued May 19, 1992—An electrophotographic photoreceptor is disclosed having a light-sensitive layer on an electroconductive base. The light-sensitive layer is formed from a dispersion in which a titanyl phthalocyanine having at least two predominant peaks at Bragg angle 2Θ at 9.6°±0.2° and 27.2°±0.2° in a diffraction spectrum obtained with characteristic x-rays of Cu Ka at a wavelength of 1.54 Angstrom is dispersed in a dispersion medium that contains at least one of branched acetate ester and alcohol solvents as a chief component. Charge generation particle sizes having an average particle size of 2 micrometer or below, preferably 1 micrometer or below are also disclosed. Also, the use of a sand mill to disperse titanyl phthalocyanine is mentioned in Example 1.

U.S. Pat. No. 4,728,592 to Ohaku et al., issued Mar. 1, 1988—An electrophotoconductor is disclosed having a light sensitive layer comprising a titanyl phthalocyanine dispersed in a binder, the titanyl phthalocyanine having a certain specified structure. The titanyl phthalocyanine may be employed in combination with a binder such as butyral resin. Mixing of titanyl phthalocyanine in a paint shaker for two hours with glass beads is mentioned in Example 1 and the use of a ball mill for 18 hours with alumina beads is mentioned in Examples 2, 4–7, and 16–21.

U.S. Pat. No. 4,898,799 to Fujimaki et al., issued Feb. 6, 1990—A photoreceptor for electrophotography is disclosed containing a titanyl phthalocyanine compound which has certain specified major peaks in terms of Bragg's 2Θ angles. The binders used to form the carrier generator layer may include polyvinyl butyral. Ball milling with the addition of binder and solvent is mentioned in Examples 4 and 14.

U.S. Pat. No. 4,882,254 to Loutfy et al, issued Nov. 21, 1989—A layered photoresponsive imaging member is disclosed comprising a supporting substrate; a photogenerating layer and an ayrl amine hole generating layer, the mixture comprising perylenes and phthalocyanines; polycyclic quinones and phthalocyanines; and perinones and phthalocyanines. Various photogenerator layer binder resins are disclosed including polyvinyl butyral. Also, preparation of a polymeric slurry by mixing pigment with polymers and solvents with various devices such as ball mills, attritors, or paint shakers is disclosed. In Example II, a perylene and vanadyl phthalocyanine are mixed for 24 hours with a binder and solvent in a glass bottle containing stainless steel shot. Roll milling is also mentioned in Example III.

U.S. Pat. No. 4,587,189 to Hor et al., issued May 6, 1986—A layer photoresponsive imaging member is disclosed comprising a supporting substrate; a vacuum evaporated photogenerator layer comprising certain specified perylene pigments; and an arylamine transport layer comprising molecules having a specified structural formula. Examples of polymeric binder resins that can be selected for the photogenerator pigment include polyvinyl butyral. In Example II, a perylene is mixed for 24 hours with a binder and solvent in a glass bottle containing stainless steel shot.

U.S. Pat. No. 4,514,482 to Loutfy et al., issued, Apr. 30, 1985—A photoresponsive device is disclosed comprising a supporting substrate and a photoconductive layer comprising a perylene dye composition having a specified formula. The polymeric binder resins for the perylene include, for example, polyvinyl butyral.

U.S. Pat. No. 4,265,990 to Stolka et al., issued May 5, 1981—A photosensitive member is disclosed having at least two electrically operative layers. The first layer comprises a photoconductive layer and the second layer comprises a charge transport layer. The charge transport layer comprises a polycarbonate resin and a diamine having a certain specified structure. Also, metal phthalocyanines are disclosed as useful as charge generators. A photoconductor particle size of about 0.01 to 5.0 micrometers is mentioned.

U.S. Pat. No. 4,429,029 to Hoffmann et al., issued Jan. 31, 1984—An electrophotographic recording medium is disclosed containing an electrically conductive base and photosemiconductive double layer comprising a first layer containing charge carrier-producing dyes and a second layer containing one or more compounds which are carrier-transporting when exposed to light, the charge carrier-producing dyes having a certain specified structure. The tumbling of a perylene, binder and solvent on a roller-stand for 12 hours is mentioned in Examples 1 and 2.

U.S. Pat. No. 3,121,006 to Middleton et ai., issued Feb. 11, 1964—A xerographic process is disclosed which utilizes a xerographically sensitive member comprising an insulating organic binder having dispersed therein finely-divided particles of an inorganic photoconductive insulating metallic-ions containing crystalline compound. Various specific insulating organic binders are disclosed. Ball milling is mentioned, for example, in Examples 45, 47–49 and 53–70.

Copending application Ser. No. 08/008,587 entitled IMAGING MEMBERS WITH MIXED BINDERS, filed in the names of Charles G. Allen and Ah-Mee Hor on Jan. 25, 1993 (D/92405). A layered photoconductive imaging member is disclosed comprising a supporting substrate, a photogenerator layer comprising perylene photoconductive pigments dispersed in a resin binder mixture comprised of at least two polymers and a charge transport layer. The resin binder mixture can include poly(vinyl butyral) as one of the binders. Disclosed solvents include methoxylethyl acetate and the like. A binder mixture of PVK and poly(vinyl butyral) (BUTVAR B76® from Monsanto molecule weight equals 50,000) is disclosed, for example, in Example IV. The entire disclosure of this application is incorporated herein by reference.

Copending U.S. application Ser. No. 08/024,145 entitled PROCESS FOR THE PREPARATION OF TITANYL PHTHALOCYANINES, filed by Trevor I. Martin et al. on Mar. 1, 1993 (D/92270)—Titanyl phthalocyanine, both the Type I polymeric and an improved crystal form of titanyl phthalocyanine (TiOPc) Type I, are described. Also disclosed are photogenerator layers containing TiOPc in a binder such as poly(vinyl butyral). Solvents for the binders include butyl acetate.

U.S. application Ser. No. 106,466, filed concurrently herewith in the names of Martha J. Stegbauer, Richard Nealey and Robert Waugh, entitled ELECTROSTATOGRAPHIC IMAGING MEMBERS CONTAINING VANADYL PHTHALOCYANINE, now U.S. Pat. No. 5,324,615. A process for fabricating an electrophotographic imaging member is disclosed comprising providing an electrophotographic imaging member comprising providing a substrate to be coated, forming a coating comprising vanadyl phthalocyanine pigment particles having an average particle size of less than about 0.6 micrometer dispersed in a solution of a solvent comprising alkyl acetate having from 3 to 5 carbon atoms in the alkyl group and a film forming polymer consisting essentially of a polyvinyl butyral having a specified general formula, drying the coating to remove substantially all of the alkyl acetate solvent to form a dried charge generation layer containing between about 20 percent and about 45 percent by weight vanadyl phthalocyanine pigment particles, and forming a charge transport layer.

U.S. application Ser. No. 107,108, filed concurrently herewith in the names of Trevor I. Martin, Sharon E. Normandin, Kathleen M. Carmichael and Donald P. Sullivan, entitled TITANYL PHTHALOCYANINE IMAGING MEMBER AND PROCESS and identified by the Docket Number D/92271—A process is disclosed for increasing the imaging cyclic stability of titanyl phthalocyanines by adding to the titanyl phthalocyanines a perylene. Preparation of a photogenerator layer containing titanyl phthalocyanine Type IV, poly(vinyl butyral) (BMS) and n-butyral acetate is disclosed in Example I, preparation of a photogenerator layer containing benzimidazole perylene, poly(vinyl butyral) (BMS) and n-butyral acetate is disclosed in Example I and preparation of mixtures of these materials is disclosed in Example V–VII.

As described above, there is a continuing need for an improved process for fabricating high quality photoreceptors.

SUMMARY OF THE INVENTION

It is, therefore, an object of the present invention to provide an improved process which overcomes the above-noted deficiencies.

It is yet another object of the present invention to provide an improved process for fabricating electrophotographic imaging members by dip coating that have high quality photoconductive coatings.

It is still another object of the present invention to provide an improved process for fabricating electrophotographic imaging members by roll coating that have uniform continuous photoconductive coatings.

It is another object of the present invention to provide an improved process for fabricating electrophotographic imaging members in which the sensitivity can be controlled by changing the ratio of phthalocyanine particles present in the charge generating layer.

These and other objects of the present invention are accomplished by providing an electrophotographic imaging member comprising providing a substrate to be coated, forming a coating comprising photoconductive pigment particles having an average particle size of less than about 0.6 micrometer dispersed in a solution of a solvent comprising alkyl acetate having from 3 to 5 carbon atoms in the alkyl group and a film forming polymer consisting essentially of a film forming polymer having the following general formula:
wherein:

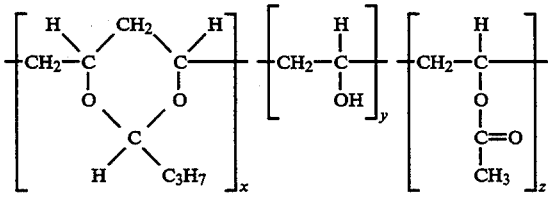

polyvinyl butyral — polyvinyl alcohol — polyvinyl acetate x is a number such that the polyvinyl butyral content is between about 50 and about 75 mol percent, y is a number such that the polyvinyl alcohol content is between about 12 and about 50 mol percent, and z is a number such that the polyvinyl acetate content is between about 0 to 15 mol percent, the photoconductive pigment particles comprising a mixture of different phthalocyanine pigment particles free of vanadyl phthalocyanine pigment particles, drying the coating to remove substantially all of the alkyl acetate solvent to form a dried charge generation layer, and forming a charge transport layer.. The mixture of different phthalocyanine pigment particles may comprise between about 50 percent and about 90 percent by weight of the photoconductive pigment particles.

Electrostatographic imaging members are well known in the art. Typically, a substrate is provided having an electrically conductive surface. At least one photoconductive layer is then applied to the electrically conductive surface. A charge blocking layer may be applied to the electrically conductive surface prior to the application of the photoconductive layer. If desired, an adhesive layer may be utilized between the charge blocking layer and the photoconductive layer. For multilayered photoreceptors, a charge generation binder layer is usually applied onto the blocking layer and charge transport layer is formed on the charge generation layer. However, if desired, the charge generation layer may be applied to the charge transport layer.

The substrate may be opaque or substantially transparent and may comprise numerous suitable materials having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are rigid or flexible, such as thin webs.

The thickness of the substrate layer depends on numerous factors, including beam strength and economical considerations, and thus this layer for a flexible belt may be of substantial thickness, for example, about 125 micrometers, or of minimum thickness less than 50 micrometers, provided there are no adverse effects on the final electrostatographic device. In one flexible belt embodiment, the thickness of this layer ranges from about 65 micrometers to about 150 micrometers, and preferably from about 75 micrometers to about 100 micrometers for optimum flexibility and minimum stretch when cycled around small diameter rollers, e.g. 19 millimeter diameter rollers. Substrates in the shape of a drum or cylinder may comprise a metal, plastic or combinations of metal and plastic of any suitable thickness depending upon the degree of rigidity desired.

The conductive layer may vary in thickness over substantially wide ranges depending on the optical transparency and degree of flexibility desired for the electrostatographic member. Accordingly, for a flexible photoresponsive imaging device, the thickness of the conductive layer may be between about 20 angstrom units to about 750 angstrom units, and more preferably from about 100 Angstrom, units to about 200 angstrom units for an optimum combination of electrical conductivity, flexibility and light transmission. The flexible conductive layer may be an electrically conductive metal layer formed, for example, on the substrate by any suitable coating technique, such as a vacuum depositing technique. Where the substrate is metallic, such as a metal drum, the outer surface thereof is normally inherently electrically conductive and a separate electrically conductive layer need not be applied.

After formation of an electrically conductive surface, a hole blocking layer may be applied thereto. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. Blocking layers are well known and disclosed, for example, in U.S. Pat. Nos. 4,291,110, 4,338,387, 4,286,033 and 4,291,110. The disclosures of U.S. Pat. Nos. 4,338,387, 4,286,033 and 4,291,110 are incorporated herein in their entirety. The blocking layer may comprise an oxidized surface which inherently forms on the outer surface of most metal ground plane surfaces when exposed to air. The blocking layer may be applied as a coating by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. Drying of the deposited coating may be effected by any suitable conventional technique such as oven drying, infra red radiation drying, air drying and the like. The blocking layer should be continuous and have a thickness of less than about 0.2 micrometer because greater thicknesses may lead to undesirably high residual voltage.

An optional adhesive layer may applied to the hole blocking layer. Any suitable adhesive layer well known in the art may be utilized. Satisfactory results may be achieved with adhesive layer thickness between about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

The photogenerating layer of this invention may be prepared by application of a coating dispersion comprising a mixture of at least two different phthalocyanine pigment particles free of vanadyl phthalocyanine photoconductive pigment particles having an average particle size of less than about 0.6 micrometer dispersed in a solution of a film forming polymer polyvinyl butyral copolymer of this invention dissolved in solvent comprising alkyl acetate. This dispersion may be applied to the adhesive blocking layer, a suitable electrically conductive layer or to a charge transport layer. When used in combination with a charge transport layer, the photoconductive layer may be between the charge transport layer and the substrate or the charge transport layer can be between the photoconductive layer and the substrate.

Any suitable organic photoconductor particles comprising a mixture of at least two different phthalocyanine pigment particles free of vanadyl phthalocyanine pigment particles may be utilized in the process of this invention. Typical components in the phthalocyanine pigment mixtures of this invention include, for example, metal-free phthalocyanine including the X-form of metal free phthalocyanine described in U.S. Pat. No. 3,357,989, metal phthalocyanines such as copper phthalocyanine; titanyl phthalocyanines including various polymorphs identifiable by characteristic diffraction spectrums obtained with characteristic x-rays of Cu Ka at a wavelength of 1.54 Angstrom such as those having an intense major diffraction peak at a Bragg angle (2Θ±0.2°) of 27.3 and other peaks at about 9.34, 9.54, 9.72, 11.7, 14.99, 23.55, and 24.13 (referred to as Type IV), those having an intense major diffraction peak at a Bragg angle (2Θ±0.2°) of 26.3 and other peaks at about 9.3, 10.6, 13.2, 15.1, 20.8, 23.3, and 27.1 (referred to as Type I); an improved version of Type I described in copending U.S. application Ser. No. 08/024,145 entitled PROCESS FOR THE PREPARATION OF TITANYL PHTHALOCYANINES, filed by Trevor I. Martin et al. on Mar. 1, 1993 (D/92270), the entire disclosure of copending U.S. application Ser. No. 08/024,145 being incorporated herein by reference; those having an intense major diffraction peak at a Bragg angle (2Θ±0.2°) of 28.6 and other peaks at about 8.6, 12.6, 15.1 18.3, 23.5, 24.2, and 25.3 (referred to as Type II); chloro indium phthalocyanine; chloro gallium phthalocyanine, hydroxy gallium phthalocyanine, and the like. Typical mixtures of photoconductive particles include, for example, metal-free phthalocyanine and titanyl phthalocyanine particles; chloro indium phthalocyanine and titanyl phthalocyanine particles; hydroxy gallium phthalocyanine and titanyl phthalocyanine; and the like and mixtures thereof. For the sake of convenience, both Type I titanyl phthalocyanine and the improved version of Type I described in copending U.S. application Ser. No. 08/024,145 are both referred to herein as Type I titanyl phthalocyanine or titanyl phthalocyanine Type I. The photoconductive particles should be substantially insoluble in the alkyl acetate employed to dissolve the charge generator layer film forming binder.

The amount of photoconductive particles dispersed in a dried photoconductive coating varies to some extent with the specific photoconductive pigment particles selected. For example, when phthalocyanine organic pigments such as titanyl phthalocyanine, metal-free phthalocyanine and chloro indium phthalocyanine are utilized, satisfactory results are achieved when the dried photoconductive coating comprises between about 50 percent by weight and about 90 percent by weight of the all phthalocyanine pigments based on the total weight of the dried photoconductive coating. To achieve effective control of sensitivity, the dried photoconductive coating should also comprise at least about 5 percent by weight of at least each of two different phthalocyanine pigments based on the total weight of the phthalocyanine pigments present in the dried photoconductive coating. The photoconductive coating composition of this invention should be substantially free of vanadyl phthalocyanine particles because vanadyl phthalocyanine particles tend to form unstable dispersions at pigment concentrations greater than about 45 percent by weight, based on the total weight of the pigment and binder. Since the photoconductor characteristics are affected by the relative amount of pigment per square centimeter coated, a lower pigment loading may be utilized if the dried photoconductive coating layer is thicker. Conversely, higher pigment loadings are desirable where the dried photoconductive layer is to be thinner.

Generally, satisfactory results are achieved with an average photoconductive particle size of less than about 0.6 micrometer when the photoconductive coating is applied by dip coating. Preferably, the average photoconductive particle size is less than about 0.4 micrometer. Preferably, the photoconductive particle size is also less than the thickness of the dried photoconductive coating in which it is dispersed.

For multilayered photoreceptors comprising a charge generating layer and a charge transport layer, satisfactory results may be achieved with a dried photoconductive layer coating thickness of between about 0.1 micrometer and about 10 micrometers. Preferably, the photoconductive layer thickness is between about 0.2 micrometer and about 4 micrometers. However, these thicknesses also depend upon the pigment loading. Thus, higher pigment loadings permit the use of thinner photoconductive coatings. Thicknesses outside these ranges can be selected providing the objectives of the present invention are achieved.

Muiti-photogenerating layer compositions may be utilized where a photoconductive layer enhances or reduces the properties of the photogenerating layer. Examples of this type of configuration are described in U.S. Pat. No. 4,415,639, the entire disclosure of this patent being incorporated herein by reference. Other suitable photogenerating materials known in the art may also be utilized, if desired.

The film forming polymer utilized as the binder material in the photoconductive coating of this invention is the reaction product of a polyvinyl alcohol and butyraldehyde in the presence of a sulphuric acid catalyst. The hydroxyl groups of the polyvinyl alcohol react to give a random butyral structure which can be controlled by varying the reaction temperature and time. The acid catalyst is neutralized with potassium hydroxide. The polyvinyl alcohol is synthesized by hydrolyzing polyvinyl acetate. The resulting hydrolyzed polyvinyl alcohol may contain some polyvinyl acetate moieties. The partially or completely hydrolyzed polyvinyl alcohol is reacted with the butyraldehyde under conditions where some of the hydroxyl groups of the polyvinyl alcohol are reacted, but where some of the other hydroxyl groups of the polyvinyl alcohol remain unreacted. For utilization in the photoconductive layer of this invention the reaction product should have a polyvinyl butyral content of between about 50 percent and about 75 mol percent by weight, a polyvinyl alcohol content of between about 12 percent and about 50 tool percent by weight and a polyvinyl acetate content up to about 5 mol percent by weight. These film forming polymers are commercially available and include, for example, Butvar B-79 resin (available from Monsanto Chemical Co.) having a polyvinyl butyral content of about 70 mol percent, a polyvinyl alcohol content of 28 mol percent and a polyvinyl acetate content of less than about 2 mol percent, a weight average molecular weight of between about 50,000 and about 80,000; Butvar B-72 resin (available from Monsanto Chemical Co.) having a polyvinyl butyral content of about 56 tool percent by weight, a polyvinyl alcohol content of 42 mol percent and a polyvinyl acetate content of less than about 2 mol percent, a weight average molecular weight of between about 170,000 and about 250,000; and BMS resin (available from Sekisui Chemical) having a polyvinyl butyral content of about 72 mol percent, a vinyl acetate group content of about 5 mol percent, a polyvinyl alcohol content of 13 mol percent and a weight average of molecular weight of about 93,000. Preferably, the weight average molecular weight of the polyvinyl butyral utilized in the process of this invention is between about 40,000 and about 250,000.

The solvent for the film forming polymer must comprise an alkyl acetate having from 2 to 5 carbon atoms in the alkyl group such as ethyl acetate, n-propyl acetate, n-butyl acetate and amyl acetate. A preferred solvent is n-butyl acetate because it is fast drying and preserves the morphology of the pigment crystals. Also, when a solvent other than alkyl acetate is employed to dissolve the film forming polymer, the polymorphic properties of the photoconductive particles in the dispersion can be adversely affected. For example, when titanyl phthalocyanine polymorph having an intense major diffraction peak at a Bragg angle ($2\Theta\pm0.2°$) of 27.3 and other peaks at about 9.34, 9.54, 9.72, 11.7, 14.99, 23.55, and 24.13 in a diffraction spectrum obtained with characteristic x-rays of Cu K$\alpha$ at a wavelength of 1.54 Angstrom is contacted with methylene chloride or tetrehydrofuran, the material is changed to an entirely different, less desirable polymorph having an intense major diffraction peak at a Bragg angle ($2\Theta\pm0.2°$) of 26.3 and other peaks at about 9.3,10.6,13.2,15.1, 20.8, 23.3 and 27.1 . This less desirable polymorph is referred to as Type 1, which has significantly less sensitivity than the Type IV.

Any suitable technique may be utilized to disperse the pigment particles in the film forming polymer solution. Typical dispersion techniques include, for example, ball milling, roll milling, milling in vertical attritors, sand milling, and the like. The solids content of the mixture being milled does not appear critical and can be selected from a wide range of concentrations. Typical milling times using a ball roll mill is between about 4 and about 6 days. The different phthalocyanine particles can be physically combined prior to dispersing in the binder solution or separately dispersed in a binder solution and the resulting dispersions combined in the desired proportions for coating application. Blending of the dispersions may be accomplished by any suitable technique. Also, a separate concentrated mixture of each type of phthalocyanine photoconductive particles and binder solution may be initially milled and thereafter combined and diluted with additional binder solution for coating mixture preparation purposes. Preferably, a dispersion of photoconductive particles and binder solution is separately formed with milling for each different phthalocyanine component and the resulting dispersions of each different phthalocyanine component and binder solution are thereafter blended together to achieve a mixture at a concentration suitable for coating application.

Any suitable technique may be utilized to apply the coating to substrate to be coated. Typical coating techniques include dip coating, roll coating, spray coating, rotary atomizers, and the like. The coating techniques may use a wide concentration of solids. Preferably, the solids content is between about 2 percent by weight and 8 percent by weight based on the total weight of the dispersion. The expression "solids" refers to the pigment particle and binder components of the coating dispersion. These solids concentrations are useful in dip coating, roll, spray coating, and the like. Generally, a more concentrated coating dispersion is preferred for roll coating.

Drying of the deposited coating may be effected by any suitable conventional technique such as oven drying, infra red radiation drying, air drying and the like.

The active charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer. An especially preferred transport layer employed in one of the two electrically operative layers in the multilayered photoconductor of this invention comprises from about 25 percent to about 75 percent by weight of at least one charge transporting aromatic amine compound, and about 75 percent to about 25 percent by weight of a polymeric film forming resin in which the aromatic amine is soluble.

The charge transport layer forming mixture preferably comprises an aromatic amine compound of one or more compounds having the general formula:

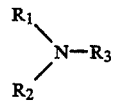

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having from 3 to 18 carbon atoms. The substituents should be free form electron withdrawing groups such as $NO_2$ groups, CN groups, and the like.

Examples of charge transporting aromatic amines represented by the structural formulae above for charge transport layers capable of supporting the injection of photogenerated holes of a charge generating layer and transporting the holes through the charge transport layer include triphenylmethane, bis(4-diethylamine-2-methylphenyl)phenylmethane; 4'-4''-bis(diethylamino)-2',2''-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3''-methylphenyl)-( 1,1'-biphenyl)-4,4'-diamine, and the like dispersed in an inactive resin binder.

Any suitable inactive resin binder soluble in methylene chloride or other suitable solvent may be employed in the process of this invention. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 150,000.

Any suitable and conventional technique may be utilized to mix and thereafter apply the charge transport layer coating mixture to the coated or uncoated substrate. Typical application techniques include spraying, dip coating, roll coating, wire wound rod coating, and the like. Drying of the deposited coating may be effected by any suitable conventional technique such as oven drying, infra red radiation drying, air drying and the like.

Generally, the thickness of the hole transport layer is between about 10 to about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to 200:1 and in some instances as great as 400:1.

The preferred electrically inactive resin materials are polycarbonate resins have a molecular weight from about 20,000 to about 150,000, more preferably from about 50,000 to about 120,000. The materials most preferred as the electrically inactive resin material is poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from the General Electric Company; a polycarbonate resin having a molecular weight of from about 18,000 to about 22,000 available as lupilon Z-200 from Mitsubishi Gas Chemical Co, and a polycarbonate resin having a molecular weight of from about 20,000 to about 50,000 available as Merlon from Mobay Chemical Company. Monochlorobenzene solvent is a desirable component of the charge transport layer coating mixture for adequate dissolving of all the components and for its low boiling point.

Examples of photosensitive members having at least two electrically operative layers include the charge generator layer and diamine containing transport layer members disclosed in U.S. Pat. No. 4,265,990, U.S. Pat. No. 4,233,384, U.S. Pat. No. 4,306,008, U.S. Pat. No. 4,299,897 and U.S. Pat. No. 4,439,507. The disclosures of these patents are incorporated herein in their entirety. The photoreceptors may comprise, for example, a charge generator layer sandwiched between a conductive surface and a charge transport layer as described above or a charge transport layer sandwiched between a conductive surface and a charge generator layer.

Optionally, an overcoat layer may also be utilized to improve resistance to abrasion. In some cases an anti-curl back coating may be applied to the side opposite the photoreceptor to provide flatness and/or abrasion resistance where a web configuration photoreceptor is fabricated. These overcoating and anti-curl back coating layers are well known in the art and may comprise thermoplastic organic polymers or inorganic polymers that are electrically insulating or slightly semi-conductive. Overcoatings are continuous and generally have a thickness of less than about 10 micrometers. The thickness of anti-curl backing layers should be sufficient to substantially balance the total forces of the layer or layers on the opposite side of the supporting substrate layer. An example of an anti-curl backing layer is described in U.S. Pat. No. 4,654,284 the entire disclosure of this patent being incorporated herein by reference. A thickness between about 70 and about 160 micrometers is a satisfactory range for flexible photoreceptors.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

A dispersion was prepared by dissolving a film forming binder of polyvinylbutyral copolymer (B79, available from Monsanto) in n-butylacetate solvent and then adding metal free phthalocyanine pigment. The pigment to binder weight ratio was 68:32 with a 4.4 percent solids level. The dispersion was dispersed by high shear mixer (available from Shearson) for 30 minutes then passed through a homogenizer (MF 110 from Microfluidics) at 8000 psi for six passes. The particle size of the milled pigment was 0.27 micrometer. The charge generating layer coating mixture was applied by a dip coating process in which a cylindrical 40 mm diameter and 310 mm long aluminum drum coated with a 1.5 micrometers thick nylon coating was immersed into and withdrawn from the charge generating layer coating mixture in a vertical direction along a path parallel to the axis of the drum at a rate of 160 ram/min. The applied charge generation coating was dried by in oven at 106° C. for 10 minutes to form a layer having a thickness of approximately 0.2 micrometers. This coated charge generator layer was then dip coated with a charge transport mixture containing 36 percent N,N'-diphenyl-N,N'-bis(-3methylphenyl)-l, 1'-biphenyl-4,4'diamine and polycarbonate dissolved in monochlorobenzene solvent. The applied charge transport coating was dried by in a forced air oven at 118° C. for 55 minutes to form a layer having a thickness of 20 micrometers.

EXAMPLE II

A dispersion was prepared by dissolving a film forming binder of polyvinylbutyral copolymer (B79, available from Monsanto) in n-butylacetate solvent and then adding titanyl phthalocyanine pigment. The pigment to binder weight ratio was 68:32 with a 4.3 percent solids level. The dispersion was dispersed by high shear mixer (available from Shearson) for 30 minutes then passed through a homogenizer (MF110 from Microfluidics) at 8000 psi for six passes. The particle size of the milled pigment was 0.89 micrometer. The charge generating material was applied in the same manner as Example I but would not adequately coat the drums.

EXAMPLE III

A blend of material comprising 90 percent by weight of the dispersion from Example I and 10 percent by weight of the dispersion from Example II was prepared. This charge generating material was applied to a substrate coated with nylon as in Example I. The charge transfer material was applied as in Example I.

EXAMPLE IV

The electrophotographic imaging members prepared as described in Examples I, II and III were tested by electrically charging them and discharging them with light having a wavelength of 780 nm. The results are shown in Table I below:

TABLE I

| Example | Vo | % Dark Decay | dV/dX | Ve |
|---|---|---|---|---|
| I | 366 | 4.3 | 107 | 23 |
| II | — | — | — | — |

TABLE I-continued

| Example | Vo | % Dark Decay | dV/dX | Ve |
|---|---|---|---|---|
| III | 366 | 5.2 | 117 | 19 |

In the above Table I, Vo" is the initial surface potential to which the photoreceptor is charged, "% Dark Decay" is the voltage loss between two probes at a point corresponding to 0.16 secs after Vo and lasting 0.26 secs and is expressed as a percentage of Vo, Ve is surface potential after erasure of photoreceptor by approximately 300 ergs/cm2 of broad band unfiltered tungsten light, and "dV/dX" is the initial slope of voltage lost with light exposure and corresponds to the sensitivity of the photoreceptor. The electrical test results in Table I show that the addition of TiOPc dispersion to the metal free dispersion resulted in an increase of sensitivity compared to the metal free formulation by itself without significant changes in other properties.

EXAMPLE V

A dispersion was prepared by dissolving a film forming binder of polyvinylbutyral (B79, available from Monsanto Co.) in n-butylacetate solvent and then adding titanyl phthalocyanine pigment with ⅛ inch (0.3 cm) diameter stainless steel shot. The pigment to binder weight ratio was 68:32 with a 4.2 percent solids level. The dispersion was roll milled for six days. The dispersion was filtered to remove the stainless steel shot. The titanyl phthalocyanine particle size of the milled pigment was 0.61 micrometer. The titanyl phthalocyanine pigment had an intense major diffraction peak at a Bragg angle (2Θ±0.2°) of 27.3 and other peaks at about 9.34, 9.54, 9.72, 11.7, 14.99, 23.55, and 24.13. The charge generating material was coated on a substrate coated with nylon as in Example I except at a pull rate of 200 mm/min. The charge transfer materials was coated as in Example I.

EXAMPLE VI

A dispersion was prepared by dissolving a film forming binder of polyvinylbutyral (B79, available from Monsanto Co.) in n-butylacetate solvent and then adding chloroindium phthalocyanine pigment with ⅛ inch (0.3 cm) diameter stainless steel shot. The pigment to binder weight ratio was 68:32 with a 4.2 percent solids level. The dispersion was roll milled for six days. The dispersion was filtered to remove the stainless steel shot. The chloroindium phthalocyanine particle size of the milled pigment was 0.36 micrometer. The charge generating material was coated on a substrate coated with nylon as in Example V. After drying, a charge transport layer as described in Example I was applied to form electrophotographic imaging members.

EXAMPLE VII

A blend of material comprising 75 percent by weight of the dispersion from Example V and 25 percent by weight of dispersion from Example VI was prepared. This charge generating material was applied to a substrate coated with nylon as in Example V. The charge transfer material was applied as in Example I.

EXAMPLE VIII

A blend of material comprising 50 precent by weight of dispersion from Example V and 50 percent by weight of the dispersion from Example VI was prepared. This charge generating material was applied to a substrate coated with nylon as in Example V. The charge transfer material was applied as in Example I.

EXAMPLE IX

A blend of material comprising 25 percent by weight of the dispersion from Example V and 75 percent by weight of the dispersion from Example VI was prepared. This charge generating material was applied to a substrate coated with nylon as in Example V. The charge transfer material was applied as in Example I.

EXAMPLE X

The electrophotographic imaging members prepared as described in Examples V, VI, VII, VIII and IX were tested by electrically charging them and discharging them with light having a wavelength of 780 nm. The results are shown in Table II below:

TABLE II

| Example | Vo | % Dark Decay | dV/dX | Ve |
|---|---|---|---|---|
| V | 337 | 3 | 299 | 22 |
| VI | 358 | 3 | 20 | 33 |
| VII | 337 | 4 | 244 | 23 |
| VIII | 336 | 4 | 175 | 24 |
| IX | 334 | 5 | 93 | 26 |

The electrical test results in Table II show that the sensitivities of the photreceptor devices can be varied between the ranges of the fast and slow components by varying the blending ratios without significant changes in other electrical properties.

EXAMPLE XI

A dispersion was prepared by dissolving a film forming binder of polyvinylbutyral (B79, available from Monsanto Co.) in n-butylacetate solvent and then adding titanyl phthalocyanine type II pigment with zirbeads. The pigment to binder weight ratio was 68:32 with a 3.8 percent solids level. The dispersion was roll milled for 18 hours. The dispersion was filtered to remove the beads. The titanyl phthalocyanine particle size of the milled pigment was 0.64 micrometer. The titanyl phthalocyanine pigment had an intense major diffraction peak at a Bragg angle (2Θ±0.2°) of 28.6 and other peaks at about 9.6, 10.7, 12.6, 15.2, 22.5, 24.2, and 25.3. The charge generating material was coated on a substrate coated with nylon as in Example V. The charge transfer materials was coated as in example I.

EXAMPLE XII

A blend of material comprising 40 percent by weight of dispersion from Example XI and 60 percent by weight of dispersion from Example VI was prepared. This charge generating material was applied to a substrate coated with nylon as in Example V. The charge transfer material was applied as in Example I.

EXAMPLE XIII

The electrophotographic imaging members prepared as described in Examples VI, XI and XII were tested by electrically charging them and discharging them with light having a wavelength of 780 nm. The results are shown in Table III below:

TABLE I

| Example | Vo | % Dark Decay | dV/dX | Ve |
|---|---|---|---|---|
| VI | 358 | 3 | 20 | 33 |
| XI | 372 | 2 | 87 | 24 |
| XII | 367 | 3 | 50 | 21 |

This shows that sensitivity is a direct function of the amount of the fast component of the mixture.

EXAMPLE XIV

A dispersion was prepared by dissolving a film forming binder of polyvinylbutyral (B79, available from Monsanto Co.) in n-butylacetate solvent and then adding hydroxy gallium phthalocyanine pigment with zirbeads. The pigment to binder weight ratio was 64:36 with a 5 percent solids level. The dispersion was roll milled for six days. The dispersion was filtered to remove the beads. The hydroxy gallium phthalocyanine particle size of the milled pigment was 0.35 micrometer. The hydroxy gallium phthalocyanine pigment type V had an intense major diffraction peak at a Bragg angle ($2\Theta \pm 0.2°$) of 28.3 and 7.5 and other peaks at about 25.2, 22.8, 17.5, 16.3, 12.5 and 10.0. The charge generating material was coated on a substrate coated with nylon as in Example V. The charge transfer materials was coated as in Example I.

EXAMPLE XV

A blend of material comprising 25 percent by weight of dispersion from example XIV and 75% by weight of dispersion from Example VI was prepared. This charge generating material was applied to a substrate coated with nylon as in Example V. The charge transfer material was applied as in Example I.

EXAMPLE XVI

A blend of material comprising 50 percent by weight of dispersion from Example XIV and 50 percent by weight of dispersion from Example VI was prepared. This charge generating material was applied to a substrate coated with nylon as in Example V. The charge transfer material was applied as in Example I.

EXAMPLE XVII

A blend of material comprising 75 percent by weight of dispersion from Example XIV and 25 percent by weight of dispersion from Example VI was prepared. This charge generating material was applied to a substrate coated with nylon as in Example V. The charge transfer material was applied as in Example I.

EXAMPLE XVIII

The electrophotographic imaging members prepared as described in Examples VI, XIV, XV, XVI and XVII were tested by electrically charging them and discharging them with light having a wavelength of 780 nm. The results are shown in Table IV below:

TABLE IV

| Example | Vo | percent Dark decay | dV/dX | Ve |
|---|---|---|---|---|
| VI | 358 | 3 | 20 | 33 |
| XIV | 366 | 7 | 151 | 34 |
| XV | 418 | 6 | 49 | 36 |
| XVI | 416 | 7 | 71 | 39 |
| XVII | 414 | 7 | 105 | 35 |

This shows that sensitivity is a direct function of the amount of the fast component of the mixture.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. A process for fabricating an electrophotographic imaging member comprising providing an electrophotographic imaging member comprising providing a substrate to be coated, forming a coating comprising photoconductive pigment particles having an average particle size of less than about 0.6 micrometer dispersed in a solution of a solvent comprising alkyl acetate having from 2 to 5 carbon atoms in the alkyl group and a film forming polymer consisting essentially of a film forming polymer having the following general formula:

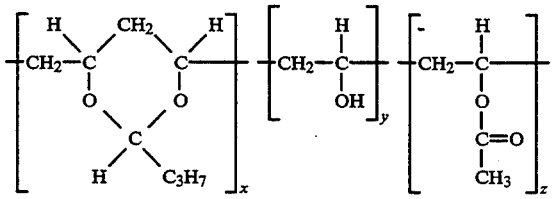

polyvinyl butyral — polyvinyl alcohol — polyvinyl acetate wherein x is a number such that the polyvinyl butyral content is between about 50 and about 75 mol percent, y is a number such that the polyvinyl alcohol content is between about 12 and about 50 mol percent, and z is a number such that the polyvinyl acetate content is between about 0 to 15 mol percent, said photoconductive pigment particles comprising a mixture of at least two different phthalocyanine pigment particles free of vanadyl phthalocyanine pigment particles, drying said coating to remove substantially all of said alkyl acetate solvent to form a dried charge generation layer comprising between about 50 percent and about 90 percent by weight pigment particles based on the total weight of said dried charge generation layer and at least about 5 percent by weight of at least each of two of said different phthalocyanine pigments based on the total weight of the phthalocyanine pigments present in said dried photoconductive coating, and forming a charge transport layer.

2. A process for fabricating an electrophotographic imaging member according to claim 1 wherein said alkyl acetate is n-butyl acetate.

3. A process for fabricating an electrophotographic imaging member according to claim 1 wherein said charge generating layer is between said supporting substrate and said charge transport layer.

4. A process for fabricating an electrophotographic imaging member according to claim 1 wherein said phthalocyanine particles are a mixture of the X-form of metal free phthalocyanine particles and titanyl Type IV phthalocyanine particles.

5. A process for fabricating an electrophotographic imaging member according to claim 1 wherein said phthalocyanine pigment particles are a mixture of titanyl phthalocyanine and chloroindium phthalocyanine particles.

6. A process for fabricating an electrophotographic imaging member according to claim 1 wherein said phthalocyanine pigment particles are a mixture of titanyl Type II phthalocyanine and chloroindium phthalocyanine particles.

7. A process for fabricating an electrophotographic imaging member according to claim 1 wherein said phthalocyanine pigment particles are a mixture of titanyl Type IV phthalocyanine and chloroindium phthalocyanine particles.

8. A process for fabricating an electrophotographic imaging member according to claim 1 wherein said phthalocyanine pigment particles are a mixture of chlorogallium phthalocyanine particles and chloroindium phthalocyanine particles.

9. A process for fabricating an electrophotographic imaging member according to claim 1 wherein said phthalocyanine pigment particles are a mixture of hydroxygallium phthalocyanine particles and chloroindium phthalocyanine particles.

10. A process for fabricating an electrophotographic imaging member according to claim 1 wherein said charge transport layer comprises charge transporting aromatic amine molecules.

11. A process for fabricating an electrophotographic imaging member according to claim 1 including separately forming, with milling, a dispersion of each of said different phthalocyanine pigment particles in said solution, and blending the resulting dispersions of each different phthalocyanine component together to achieve a coating for forming on said substrate.

12. A process for fabricating an electrophotographic imaging member comprising providing an electrophotographic imaging member comprising providing a substrate to be coated, separately forming, with milling, a first dispersion of particles of a first photoconductive phthalocyanine pigment in a first solution and a second dispersion of particles of a second phthalocyanine pigment different from said first photoconductive phthalocyanine pigment in a second solution until each of said dispersions contain photoconductive pigment particles having an average particle size of less than about 0.6 micrometer, each of said solutions comprising a solvent comprising alkyl acetate having from 2 to 5 carbon atoms in the alkyl group and a film forming polymer consisting essentially of a film forming copolymer having the following general formula:

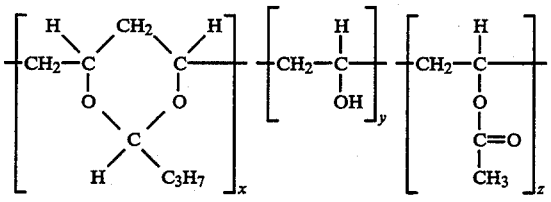

wherein:

x is a number such that the polyvinyl butyral content is between about 50 and about 75 mol percent, y is a number such that the polyvinyl alcohol content is between about 12 and about 50 mol percent, and z is a number such that the polyvinyl acetate content is between about 0 to 15 mol percent, blending the resulting dispersions together to achieve a coating mixture containing between about 2 percent by weight and 8 percent by weight of said first photoconductive phthalocyanine pigment, said second photoconductive phthalocyanine pigment and said film forming copolymer based on the total weight of said coating mixture, said coating mixture being free of vanadyl phthalocyanine pigment particles, forming a coating with said coating mixture, and drying said coating to remove substantially all of said alkyl acetate solvent to form a dried charge generation layer comprising between about 50 percent and about 90 percent by weight pigment particles based on the total weight of said dried charge generation layer and at least about 5 percent by weight of at least each of said different phthalocyanine pigments based on the total weight of the phthalocyanine pigments present in said dried photoconductive coating, and forming a charge transport layer.

* * * * *